US005129173A

United States Patent [19]

Kuykendall

[11] Patent Number: 5,129,173

[45] Date of Patent: Jul. 14, 1992

[54] MAGAZINE LOADING DEVICE

[76] Inventor: Gale Kuykendall, Rte. 1, Box 352, Cohasset, Minn. 55721

[21] Appl. No.: 743,978

[22] Filed: Aug. 12, 1991

[51] Int. Cl.[5] ..... F41A 9/83

[52] U.S. Cl. ..... 42/90

[58] Field of Search ..... 42/87, 88, 90

[56] References Cited

U.S. PATENT DOCUMENTS

| | | | |
|---|---|---|---|
| 1,245,499 | 11/1917 | Orme | 42/90 |
| 2,137,491 | 11/1938 | Huff | 42/90 |
| 2,466,017 | 4/1949 | Farber | 42/90 |
| 2,514,277 | 7/1950 | Donallan | 42/90 |
| 2,862,324 | 12/1958 | Ball | 42/90 |
| 2,864,193 | 12/1958 | Drew | 42/87 |
| 3,509,655 | 5/1970 | Wilhelm | 42/87 |
| 4,464,855 | 8/1984 | Musgrave | 42/87 |
| 4,488,371 | 12/1984 | Boyles | 42/90 |
| 4,570,370 | 2/1986 | Smith et al. | 42/90 |
| 4,570,371 | 2/1986 | Mears | 42/87 |
| 4,574,511 | 3/1986 | Csongor | 42/87 |
| 4,689,909 | 9/1987 | Howard | 42/87 |
| 4,706,402 | 11/1987 | Csongor | 42/87 |
| 4,719,715 | 1/1988 | Howard | 42/87 |
| 4,799,323 | 1/1989 | Musgrave | 42/90 |
| 4,827,651 | 5/1989 | Conkey | 42/87 |
| 4,829,693 | 5/1989 | Holmes | 42/87 |
| 4,872,279 | 10/1989 | Boat | 42/90 |

OTHER PUBLICATIONS

Super Thumb TM by Adco TM of Woburn, Mass. (Item #STI).

Clip-Loader by Clip-Loader, Inc. of Milwaukie, Ore.

Weston Loader TM by Weston Manufacturing Company of San Jose, Calif., "Petersen's Handguns" Jul. 1990, p. 35.

*Primary Examiner*—Charles T. Jordan

*Attorney, Agent, or Firm*—Peterson, Wicks, Nemer & Kamrath

[57] ABSTRACT

A device (110) for loading ammunition into a magazine (14) of a firearm is disclosed including a slide (150) movable relative to a planar portion (138) of a device body (132). The slide (150) includes a pin (128) removably insertable into a retention hole (164) formed in the slide (24) of the magazine (14). The magazine (14) is held relative to the device body (132) by the base (22) of the magazine (14) abutting with a seat (176) secured to a shelf portion (140) formed as part of the device body (132). The seat (176) includes a vertical surface (178) for spacing the base (22) of the magazine (14) away from the planar portion (138) and an inclined surface (180) for pushing the forward end of the base (22) of the magazine (14) upward. The device body (132) further includes a flange portion (142) which may be pinched by the user's hand with an outwardly extending leg (155) of the slide (150) to move the slide (150) relative to the device body (132). In the preferred form, the pin (128) extends from the spindle (156) and includes a cog for releasably engaging the intersection of first and second, coaxial portions (166, 168) forming the retention hole (164).

23 Claims, 1 Drawing Sheet

MAGAZINE LOADING DEVICE

BACKGROUND

The present invention generally relates to devices for allowing loading of ammunition into the magazine of weaponry, and in the most preferred form to devices for allowing loading of ammunition into double column magazines of weaponry.

Many automatic weapons utilize removable magazines which hold a multiple of rounds of ammunition. Such magazines include biased slides which push the rounds of ammunition to an open end of the magazine for access by the weaponry. It is then necessary to depress such biased slides when loading ammunition into the magazine. Many such magazines include depression knobs formed on the slide which may be manually depressed such as by pushing by the thumb. Because of the concentrated force placed on the knob by the sliding bias, often the slide is depressed by pushing the knob against the bottom surface of a table or the like. Auto-loaders also exist which allow rounds of ammunition to be injected into the magazine. But such auto-loaders typically are not taken into the field because of their size, thus requiring the user to possess several magazines which are preloaded with the anticipated number of rounds of ammunition to be utilized prior to going out into the field. Thus, a need exists for loading devices which may be taken out into the field and which allow ease of magazine loading. This need is especially great for small caliber handguns which are often utilized for target shooting where a large number of rounds of ammunition are expended and which are often utilized in field conditions where tables or the like and auto-loaders are not easily accessible. Further, a need exists for loading devices for double column magazines where the biasing force of the slide in the magazine is especially great making manual loading by manually forcing the ammunition into the magazine against the slide bias especially difficult.

SUMMARY

The present invention solves these needs and other problems in the field of loading ammunition into magazines of weaponry by providing, in the most preferred form, a member for removable attachment to the magazine slide movably mounted relative to a device body for moving the slide against its bias into the magazine when the magazine is removably held relative to the device body and the removable attachment member is moved relative to the device body and the magazine.

It is thus an object of the present invention to provide a novel device for allowing loading of ammunition into the magazine of weaponry.

It is further an object of the present invention to provide such a novel magazine loading device for double column magazines.

It is further an object of the present invention to provide such a novel magazine loading device allowing ease of loading under field conditions.

It is further an object of the present invention to provide such a novel magazine loading device which allows the magazine slide to be held in a depressed position while loading the magazine.

It is further an object of the present invention to provide such a novel magazine loading device of a simple design which may be easily manufactured.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
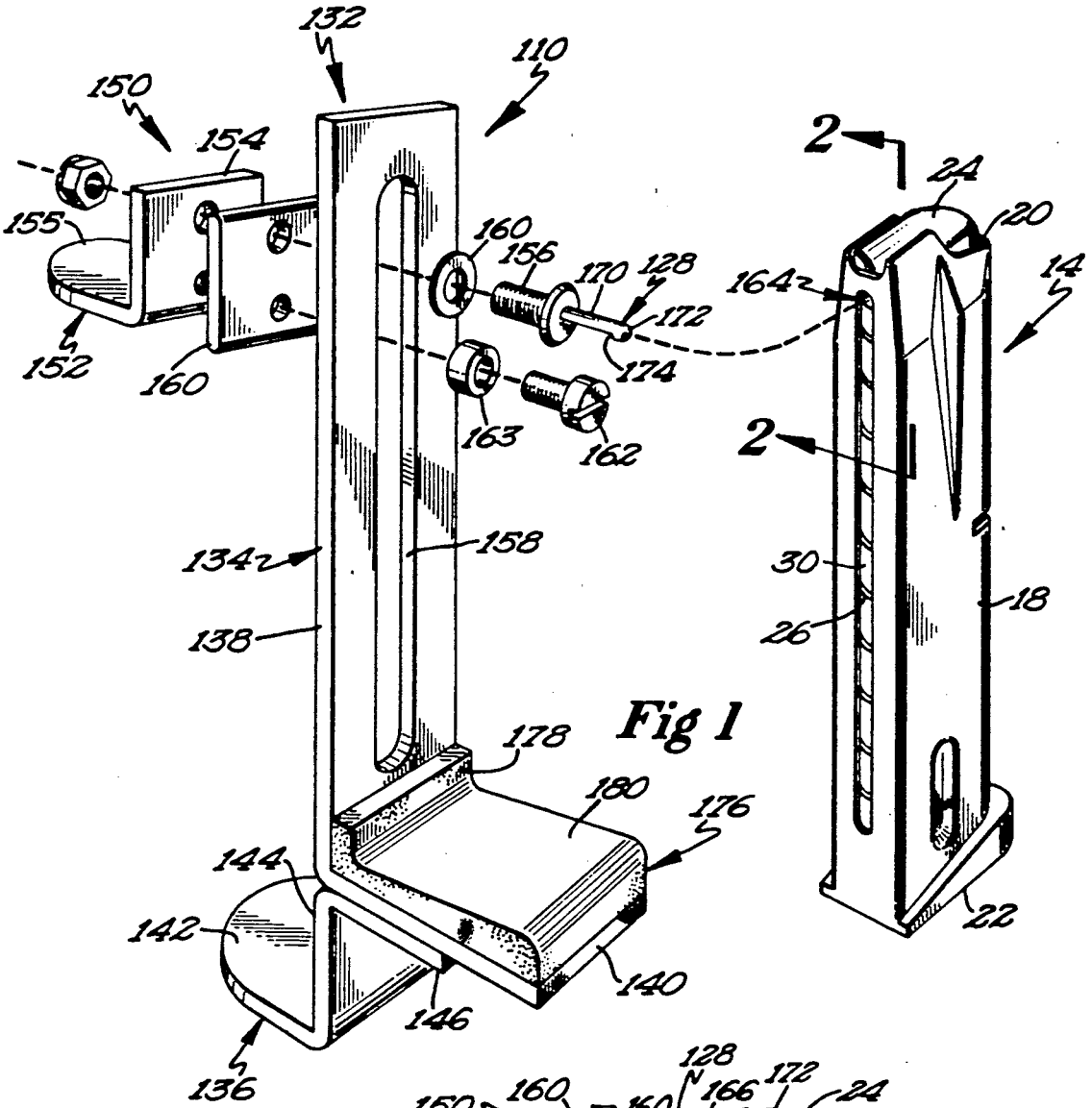
FIG. 1 shows an exploded, perspective view of a device for allowing loading of ammunition into the magazine of weaponry according to the preferred teachings of the present invention.
Figure 2:
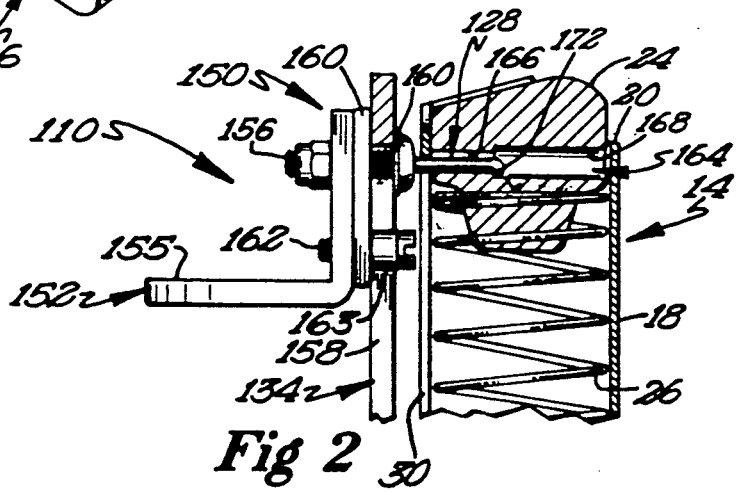
FIG. 2 shows a partial, cross sectional view of the magazine for the weaponry of FIG. 1 taken along section line 2—2 of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "end", "longitudinal", "upper", "lower", "inner", "outer", and similar terms are used herein, it should be understood that these terms have reference only to the structure shown in the drawings as it would appear to a person viewing the drawings and are utilized only to facilitate describing the invention.

DESCRIPTION

A device for allowing loading of ammunition into the magazine of weaponry is shown in its most preferred form in the drawings and generally designated 110. Specifically, in the most preferred form, device 110 is disclosed in use with a magazine 14 slideably received in semi-automatic firearms, not shown. Generally, magazine 14 includes an elongated, hollow sleeve 18 for slideable receipt of shells in a stacked, parallel arrangement through an open upper end 20. The lower end of sleeve 18 is closed by a base 22. A slide 24 is slideably moveable within sleeve 18 and biased toward open end 20 by a spring 26 sandwiched between slide 24 and base 22.

Device 110 in the most preferred form includes a body 132 including a first, generally L-shaped panel 134 and a second, generally Z-shaped plate 136 secured to panel 134. Specifically, panel 134 includes an upright, generally planar portion 138 having a length generally equal to magazine 14 and includes a shelf portion 140 extending generally perpendicular from portion 138. In the preferred form, shelf portion 140 has a length and contour to mate with base 22 of magazine 14 with sleeve 18 in a generally abutting position against portion 138. Specifically, in the preferred form, panel 134 and plate 136 are formed of metal strips bent to have the preferred shapes indicated. To mate with base 22, shelf portion 140 includes a seat 176 secured thereto and formed of non-slip type material providing a spring effect such as firm, closed cell foam. Seat 176 includes a vertical surface 178 arranged generally parallel to but spaced from planar portion 138 of panel 134. Vertical surface 178 of seat 176 acts as a spacer for abutting with the rear of magazine 14. Seat 176 further includes a generally horizontal surface 180 arranged generally parallel to but spaced from shelf portion 140 but inclined towards planar portion 138 to push magazine 14 against and toward planar portion 138.

Plate 136 generally includes a flange portion 142 extending generally perpendicularly from an upright, generally planar portion 144. Plate 136 is secured to panel 134 in the preferred form by a leg 146 extending generally perpendicularly from planar portion 144 and opposite to flange portion 142 and which is secured to shelf portion 140 such as by welding. Flange portion 142 is of a size and shape to accommodate the user's thumb and/or the tips of any other fingers.

Device 110 further includes a slide 150 slideable relative to planar portion 138 of body 132. In the preferred form, slide 150 generally includes an integral L-shaped member 152 having a first leg 154 and a second, outwardly extending leg 155. Leg 155 is of a size and shape to accommodate the user's thumb and/or tips of any other fingers. Leg 154 is slideably mounted to planar portion 138 by a spindle 156 which is rotatably and slideably received in a slot 158 formed in planar portion 138. Specifically, spindle 156 includes a cylindrical post having a diameter generally equal to but slideable within the width of slot 158 and includes a disc portion of a size larger than the width of slot 158 and on the side of planar portion 138 opposite to leg 154. For ease of sliding, bushings 160 made of material having a low coefficient of sliding friction such as nylon are sandwiched between leg 154 and planar portion 138 and the enlarged disc of spindle 156 and planar portion 138 to reduce sliding friction. A set screw 162 extends from leg 154 and bushing 160 and extends through a collar 163 having a diameter generally equal to but slideable within the width of slot 158. Screw 162 and collar 163 prevent rotation of member 152 relative to planar portion 138 and about spindle 156 after assembly.

Provisions 128 are further provided to manually depress slide 24 within sleeve 18 and against the bias of spring 26 to allow dropping of shells through open end 20 into sleeve 18 and without requiring the shells to push slide 24 against the bias of spring 26. In the most preferred form, provisions 128 are shown as a pin secured to and extending from spindle 156 of slide 150 and extending through an elongated longitudinal slot 30 formed in the sides of sleeve 18 of magazine 14 and into a retention hole 164 formed in slide 24. It can then be appreciated that pin 128 for removable attachment to slide 24 of magazine 14 is movably mounted to panel 134 of body 132 by slide 150 and spindle 156.

In the preferred form, retention hole 164 includes a first portion 166 extending from the end of slide 24 adjacent to planar portion 138 which is contiguous with a second portion 168 extending from the opposite end of slide 24. Portion 166 has a cross-sectional size larger than and for slideable receipt of pin 128. Portion 168 has a cross-sectional size larger than pin 128 and larger than portion 166. In the most preferred form, portions 166 and 168 have circular cross sections and are coaxial. In the preferred form, pin 128 includes a first inner portion 170, a second outer portion 172, and an intermediate portion 174. First portion 170 in the most preferred form has a circular cross section and a length greater than the length of first portion 166 of retention hole 164. Second portion 172 has a generally oval cross section having a major axis parallel to the length of slot 158 of planar portion 138. Specifically, the upper portion of second portion 172 has a semi-circular cross section corresponding to first portion 170 and the lower portion of second portion 172 has a cross section including straight sides extending tangentially from the upper portion and terminating in an arcuate or semi-circular member. The upper portion of intermediate portion 174 has a semi-circular cross section corresponding to the upper portion of second portion 172 and to first portion 170 and a lower portion having an arcuate portion extending between and smoothly interconnecting first portion 170 with the lower portion of second portion 172. It can then be appreciated that portions 172 and 174 form a cog in pin 128.

Now that the basic construction of device 110 according to the preferred teachings of the present invention has been explained, the operation and subtle features of device 110 can be set forth and appreciated. An empty magazine 14 may be positioned adjacent and generally parallel to the outside face of portion 138 of panel 134 of body 132. Pin 128 of slide 150 may then be positioned to extend through slot 30 and into hole 164 of slide 24 of magazine 14. At that time, magazine 14 may be moved towards panel 134 with base 22 located above or sliding along seat 176 of shelf portion 140. As magazine 14 moves relative to panel 134, pin 128 will slide in hole 164 of slide 24 of magazine 14. Magazine 14 is moved until engagement with vertical surface 178 of seat 176 occurs, with vertical surface 178 helping to maintain the proper attitude for magazine 14 under the stress created when compressing spring 26 of magazine 14. Further, the spring action of surface 180 pushes up on the forward end of base 22 of magazine 14 to hold magazine 14 against the disc portion of spindle 156.

Slide 150 may then be depressed by pinching flange portion 142 and leg 155 in the hand of the user. It can be appreciated that the cog of pin 128 formed by portions 172 and 174 engaging the intersection of portions 166 and 168 of retention hole 164 provides a gripping action of pin 128 with slide 24 while still allowing pin 128 to move and change angular position within retention hole 164 as slide 150 is moved relative to body 132. This gripping action helps reduce the possibility of magazine 14 jumping away from device 110 as slide 150 is moved downwardly. Initial movement of slide 150 will push base 22 of magazine 14 to abut against seat 176 of shelf portion 140 of panel 134 to prevent further relative movement of magazine 14 relative to device 110. Continued depression of slide 150 relative to panel 134 causes slide 24 to slide in sleeve 18 of magazine 14 against the bias of spring 26 towards base 22. With slide 24 held adjacent its lowest, depressed position within sleeve 18 by device 110 according to the preferred teachings of the present invention, shells may be dropped through open end 20 of magazine 14 to load magazine 14 by the user's other hand. Alternately, slide 24 may be compressed as the shells are loaded through open end 20 of magazine 14. This is especially important for double column magazines 14 because a shell has less chance to fall wrong when the shell is dropped only a short distance through open end 20 when slide 24 is sequentially compressed. Further, if one shell should fall wrong in sleeve 18 due to the large space therein, it is possible to release pressure on slide 24 by device 110 for ease of access of the misfallen shell in magazine 14 through open end 20. It can then be appreciated that loading of magazine 14 may be easily accomplished while holding device 110 in one hand of the user while the shells are placed in magazine 14 with the user's other hand and without the necessity of pushing the shells against the bias of spring 26 while loading.

After magazine 14 is loaded with the desired number of shells, the clamping force on flange portion 142 and leg 155 may be released until the upper shell in magazine 14 engages upper end 20 of magazine 14. With slide 24 held by the shells in magazine 14, body 132 may be moved relative to magazine 14 removing pin 128 from hole 164 of slide 24. It can be appreciated that with pin 128 positioned adjacent the upper portion of retention hole 164, the cog formed by portions 172 and 174 may easily pass through portion 166 of hole 164 without catching. After device 110 is separated from magazine 14, device 110 may be set aside or may be utilized to assist loading the next, empty magazine 14.

Now that the basic teachings of the preferred form of the present invention have been explained, many extensions and variations will be obvious to one having ordinary skill in the art. For example, although provisions 128 and 164 have been shown and explained in the preferred form as a pin and a hole, such provisions may take other forms and configurations. An example of alternate forms would include a cavity formed in slide 150 of device 110 which may be engaged by a knob formed on slide 24 extending through slot 30 formed in sleeve 18.

Likewise, although in the preferred form, the cog is formed by portions 172 and 174 of the set forth shapes, it can be appreciated that the cog can take other forms. For example, the cog could be formed by a spherical ball such that the cog is not rotationally dependent upon the position of first portion 170. Thus, pin 128 may be assembled in slide 150 in any rotational position without affecting the operation of the spherical-shaped cog.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for allowing loading of ammunition into a magazine of weaponry, with the magazine including a hollow sleeve having an open end and a base and including a slide movable within the hollow sleeve from adjacent to the base to the open end, with the slide being biased from adjacent the base towards the open end, comprising, in combination: a device body movable relative to the hollow sleeve of the magazine; means for removable attachment to a portion of the slide of the magazine; means for movably mounting the removable attachment means relative to the device body causing the slide to move within the hollow sleeve against the bias from the open end towards the base as the removable attachment means is moved relative to the device body; and means for removably holding the hollow sleeve of the magazine relative to the device body as the removable attachment means is moved relative to the device body.

2. The device of claim 1 wherein the removably holding means comprises, in combination: means for abutting with the base of the magazine.

3. The device of claim 2 wherein the abutting means comprises, in combination: a shelf portion formed on the device body for abutting with the base of the magazine.

4. The device of claim 3 wherein the shelf portion includes a seat formed of material providing a spring type action against the base of the magazine.

5. The device of claim 4 wherein the seat includes a vertical surface for spacing the magazine from the device body for maintaining the proper attitude for the magazine relative to the device body.

6. The device of claim 3 wherein the shelf portion includes a surface at a slight incline towards the device body for pushing up on the end of the base of the magazine opposite to the removable attachment means.

7. The device of claim 3 wherein the movably mounting means comprises means for slideably mounting the removable attachment means relative to the device body.

8. The device of claim 7 wherein the slideably mounting means comprises an elongated slot formed in the device body, with the removable attachment means slideable in the elongated slot of the device body.

9. The device of claim 8 wherein the slideably mounting means further comprises, in combination: a device slide; and a spindle secured to the device slide and slideably received in the elongated slot of the device body, with the removable attachment means located on the spindle.

10. The device of claim 9 wherein the hollow sleeve of the magazine includes an elongated slot and the slide includes a hole formed therein and accessible through the elongated slot of the hollow sleeve; and wherein the removable attachment means comprises a pin extending from the spindle and for receipt in the hole of the slide.

11. The device of claim 10 wherein the slideably mounting means further comprises, in combination: means extending from the device slide into the elongated slot of the device body and spaced from the spindle to prevent the device slide from pivoting relative to the device body about the spindle.

12. The device of claim 9 wherein the slideably mounting means further comprises, in combination: a bushing formed of material having a low coefficient of sliding friction, with the bushing located between the device slide and the device body.

13. The device of claim 9 wherein the slide includes an outwardly extending leg and the device body includes a flange portion arranged, generally parallel to the outwardly extending leg of the device slide, with the outwardly extending leg and the flange portion being pinched by the user's hand to move the device slide relative to the device body.

14. Device for allowing loading of ammunition into a magazine of weaponry, with the magazine including a hollow sleeve having an open end and a base and including a slide movable within the hollow sleeve from adjacent to the base to the open end, with the slide being biased from adjacent the base towards the open end, comprising, in combination: a device body movable relative to the hollow sleeve of the magazine; means for removable attachment to a portion of the slide of the magazine; and means for movably mounting the removable attachment means relative to the device body causing the slide to move within the hollow sleeve against the bias from the open end towards the base as the removable attachment means is moved relative to the device body; wherein the slideably mounting means comprises an elongated slot formed in the device body, with the removable attachment means slideable in the elongated slot of the device body.

15. The device of claim 14 wherein the slideably mounting means further comprises, in combination: a device slide; and a spindle secured to the device slide and slideably received in the elongated slot of the device body, with the removable attachment means located on the spindle.

16. The device of claim 15 wherein the device slide includes an outwardly extending leg and the device body includes a flange portion arranged generally parallel to the outwardly extending leg of the device slide, with the outwardly extending leg and the flange portion being pinched by the user's hand to move the device slide relative to the device body.

17. Device for allowing loading of ammunition into a magazine of weaponry, with the magazine including a hollow sleeve having an open end, a base, and an elongated slot and including a slide movable within the hollow sleeve from adjacent to the base to the open end, with the slide including a hole formed therein accessible through the elongated slot of the hollow sleeve and being biased from adjacent the base towards the open end, comprising, in combination: a device body movable relative to the hollow sleeve of the magazine; means for removable attachment to a portion of the slide of the magazine comprising a pin extending from a spindle and for receipt in the hole of the slide; and means for movably mounting the removable attachment means relative to the device body causing the slide to move within the hollow sleeve against the bias from the open end towards the base as the removable attachment means is moved relative to the device body.

18. The device of claim 17 wherein the free end of the pin includes a cog; and wherein the hole in the slide includes means for releasably engaging the cog of the pin.

19. The device of claim 18 wherein the releasably engaging means comprises a first portion of the hole having a cross-sectional size for slideable receipt of the pin and a second portion of the hole having a cross-sectional size larger than the cross-sectional size of the first portion and contiguous with the first portion.

20. The device of claim 19 wherein the first and second portions of the hole are cylindrical in shape and coaxial.

21. Device for allowing loading of ammunition into a magazine of weaponry, with the magazine including a hollow sleeve having an open end, a base, and an elongated slot and including a slide movable within the hollow sleeve from adjacent to the base to the open end, with the slide including a hole formed therein accessible through the elongated slot of the hollow sleeve and being biased from adjacent the base towards the open end, comprising, in combination: a pin for extending through the elongated slot and for receipt in the hole of the slide, with the free end of the pin including a cog; and wherein the hole in the slide includes means for releasably engaging the cog of the pin.

22. The device of claim 21 wherein the releasably engaging means comprises a first portion of the hole having a cross-sectional size for slideable receipt of the pin and a second portion of the hole having a cross-sectional size larger than the cross-sectional size of the first portion and contiguous with the first portion.

23. The device of claim 22 wherein the first and second portions of the hole are cylindrical in shape and coaxial.

* * * * *